United States Patent [19]

Lenderink et al.

[11] 4,019,548

[45] Apr. 26, 1977

[54] MACHINE FOR SHEAR-SLICING WOOD

[75] Inventors: Thomas A. Lenderink; Roger P. Hordyk, both of Plainfield Township, Kent County, Mich.

[73] Assignee: Lenderink, Inc., Belmont, Mich.

[22] Filed: Feb. 2, 1976

[21] Appl. No.: 564,337

[52] U.S. Cl. ..... 144/175; 83/4; 83/425.2; 144/184; 144/193 R; 144/242 R

[51] Int. Cl.[2] ..... B27C 1/00

[58] Field of Search ..... 83/446, 447, 4, 425.2; 198/160; 271/151, 274; 144/175, 185, 190, 193 R, 323, 3 K, 242 R, 242 A, 242 C, 246 R, 249 R, 182, 212, 178, 184, 155

[56] References Cited

UNITED STATES PATENTS

| | | | |
|---|---|---|---|
| 68,203 | 8/1867 | Jewett | 144/212 |
| 70,545 | 11/1867 | Goodard | 144/184 |
| 106,671 | 8/1870 | Davis | 144/178 |
| 359,391 | 3/1887 | Jarves | 83/4 |
| 477,201 | 6/1892 | Damus | 144/178 |
| 534,746 | 2/1895 | Jarves | 83/4 |
| 1,503,784 | 8/1924 | Dumont | 144/184 |
| 1,771,456 | 7/1930 | Alexander | 83/425.2 |
| 1,805,906 | 5/1931 | Dennis | 144/242 R |
| 2,323,760 | 7/1943 | Wolfinger, Sr. | 83/425.2 |
| 3,295,569 | 1/1967 | Sweet | 144/175 |
| 3,727,654 | 4/1973 | Mochizuki | 144/175 |

*Primary Examiner*—Othell M. Simpson
*Assistant Examiner*—W. D. Bray
*Attorney, Agent, or Firm*—Price, Heneveld, Huizenga & Cooper

[57] ABSTRACT

A machine is described for shearing a block of wood into a plurality of individual sheets in a single pass through a plurality of vertically and horizontally spaced, stationary shearing knives. The knives are rigidly supported, one after the other, in vertically spaced relationship. Means are provided to force the wood block past the knives. A pressure applicator is provided for positively holding the wood block down against a horizontal supporting surface as it passes through the shearing knives. The wood block contacting surface of the pressure applicator is made up of a plurality of small diameter rod-like roller elements, each supported so that it can individually rotate with respect to adjacent roller elements. The roller elements contact each other and each is individually pressed against the wood block by a block-like mass of polyurethane elastomer of a durometer such that high unit pressure is maintained between each of the roller elements and the wood block. The machine is designed to shear the wood into sheets or boards of a greater range of thicknesses than heretofore possible and to produce such boards or sheets with a surface acceptable for many uses without subsequent planing or sanding. In a modified form, the machine can be used to shear a single sheet from a block during each pass.

19 Claims, 8 Drawing Figures

MACHINE FOR SHEAR-SLICING WOOD

FIELD OF THE INVENTION

This invention relates generally to apparatus for shearing a sheet-like section from a block of wood. In a preferred embodiment, the apparatus shears the block into a plurality of sheet-like sections when the wood is passed through equipment having a number of spaced, stationary shearing knives. The invention includes means for controlling the tendency of the wood to curl, split or twist as it passes through the knives.

BACKGROUND OF THE INVENTION

For many years, various pieces of equipment have been developed for shearing thin pieces of wood from a larger block. Most of this equipment has been of the type which shears a single sheet or strip of wood from a block during each pass. Therefore, the stock material had to be repeatedly moved past the shearing knife or the knife past the block to obtain multiple strips. Despite this drawback for a number of uses, this type of equipment was considered desirable because despite its limitations, the amount of wood saved by eliminating the kerf of a saw more than offset the disadvantages of the system. This was particularly true when the resulting product was thin such as a few thousandths or a few hundredths of an inch in thickness. In cutting materials of this type, even the thinnest of saws reduced more than half of the material to saw dust thus making shearing economically attractive.

One of the most persistent problems in utilizing the shearing technique is that of the wood splitting ahead of the knife. When this happens, the thickness of the resulting product varies because the split will tend to follow the grain rather than a straight line. Further, the resulting surface condition of the product is much rougher than when the surface results from an actual cutting action. Another problem has been that of positively preventing the wood from twisting, particularly twisting upwardly as it is being sheared. This is also important to production of a product having uniformity of thickness. When it is attempted to produce more than one slice from the workpiece in a single pass, these problems are multiplied with the result that simultaneous multi-piece shearing has not been considered a commercially feasible means of slicing wood.

SUMMARY OF THE INVENTION

The present invention is designed to provide a means of splitting a log of wood into a plurality of slices while so controlling the operation that the separation of the slices from each other and from the main workpiece is effected by shearing rather than splitting. Further, the invention is designed to provide such a means which is capable of producing a wide range of slice thicknesses. The invention provides means by which the wood, as it is passing through the blades, is positively held against a guide surface and is prevented from shifting away from this surface. This prevents curling or upward bending away from the surface which would free it to split rather than being forced to be severed by shearing against the leading edges of the several shearing blades. The equipment provides a ready means of adjusting the machine at the cutting blades to accommodate blocks of varying thickness and permits the pressure head which holds the wood down against the indexing or supporting surface during the shearing to automtically adjust itself for minor variations in the thickness of the log. This is important in increasing the machine's versatility.

DESCRIPTION OF THE PREFERRED EMBODIMENT

Figure 1:
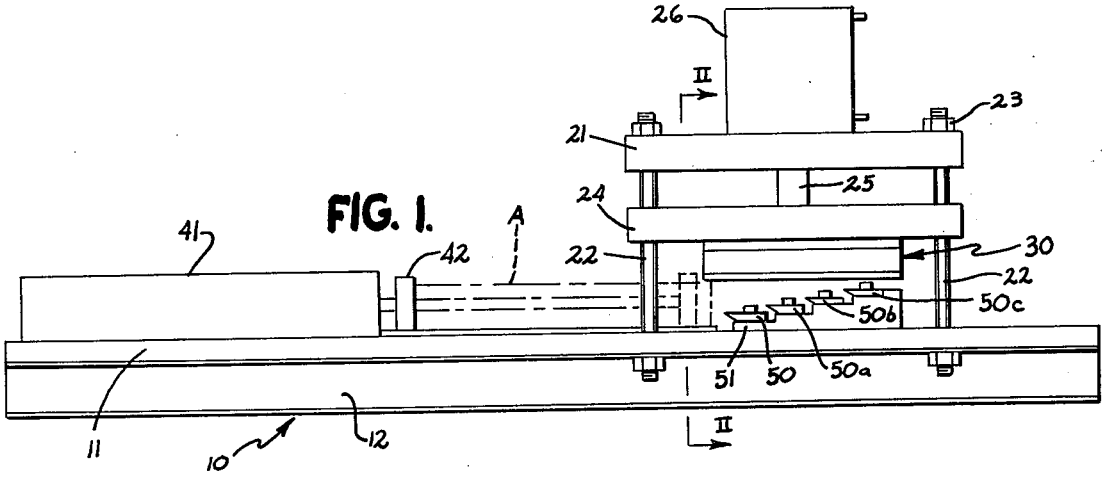
FIG. 1 is a side elevation view of a machine embodying this invention.

The numeral 10 refers to a base which can be of any suitable construction so long as it can withstand the operating loadings imposed on it without deflection. In the particular construction illustrated, it consists of a heavy slab-like base plate 11 supported by a pair of I-beams 12.

Mounted on this base plate 11 is a pressure assembly 20. The pressure assembly 20 has a cap plate 21 supported at its four corners by the posts 22. Both ends of the posts 22 are of reduced diameter and at the top extend through the cap plate 21 and at the bottom through the base plate 11 and a flange of the I-beams. The reduction in diameter of the posts provide shoulders which positively space the cap and base plates. The plates are forced tightly against the shoulders by the nuts 23.

The posts 22 also pass through and guide the pressure plate 24. The pressure plate 24 is slidable along the posts 22. The pressure plate 24 is mounted on the lower end of the piston 25 which is part of the fluid pressure cylinder assembly 26. The cylinder assembly, in turn, is rigidly secured to the cap plate 21.

Figure 3:
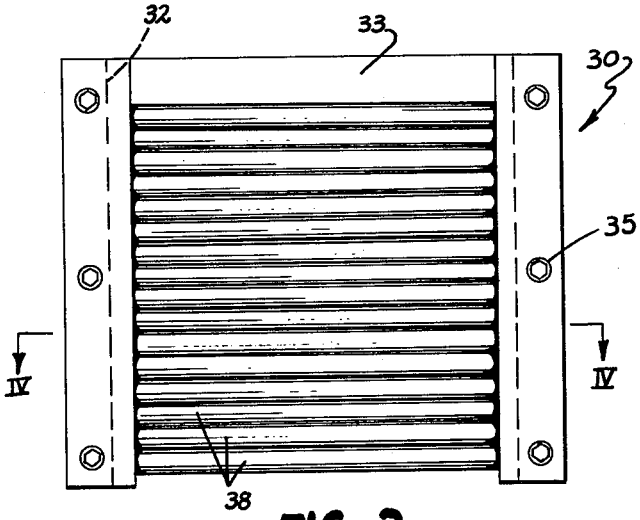
FIG. 3 is a bottom view of the pressure applicator of this machine.
Figure 2:
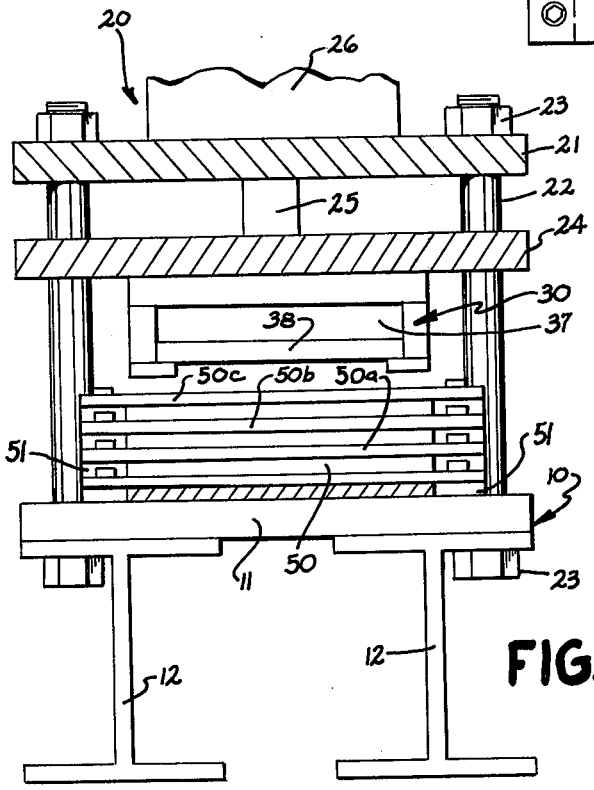
FIG. 2 is a sectional elevation view taken along the plane II—II of FIG. 1.
Figure 4:
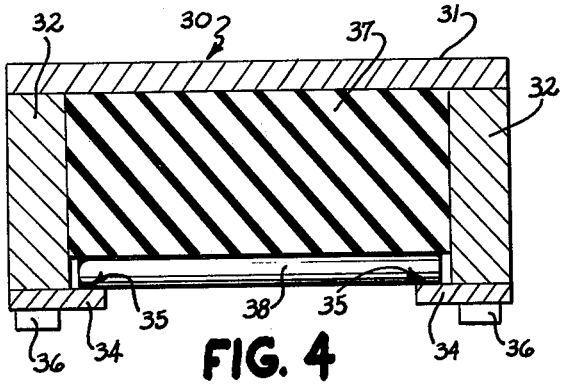
FIG. 4 is a sectional elevation view taken along the plane IV—IV of FIG. 3.

Mounted to the bottom face of the pressure plate 24 is a pressure applicator or head 30. The head 30 has a top plate 31, a pair of side members 32 and at one end a cross member or stop 33 (FIGS. 3 and 4). These components are rigidly secured together as by bolts or welding. Mounted to the bottom of each of the side members 32 is a flange plate 34. These flange plates 34 extend inwardly toward each other beyond the inside faces of the side members 32 to form a pair of ledges 35. The flange plates 34 are secured to the sides by suitable means such as heavy cap screws 36.

Mounted within the pressure head 30 is a pressure block 37. Also mounted within the pressure head and below the pressure block 37 are a plurality of rollers 38.

The rollers 38 are small diameter, steel rods. In one application 7/16 in. diameter, high tensile strength, stainless steel rods proved satisfactory as these rollers. The rollers 38 are of sufficient length to be supported on the ledges 35 but are slightly shorter than the span between the sides 32 to eliminate binding with the sides. A sufficient number of the rollers 38 are provided to form a continuous surface from the open or upstream end of the pressure head to the stop 33 at the downstream end. In operation, these rollers are tightly packed against each other.

The pressure block 37 is made up of one or more layers of a firm, resilient material. A material which has been found to be satisfactory for this purpose is a polyurethane sheet material sold by B. F. Goodrich under the trademark NOVITANE. In one particular application the grade used was CI-85 having a durometer, Shore A value of 85. Other grades and durometer values could be used. This particular material, besides having very desirable compression characteristics also has high abrasion and tear resistance. It also does not have a tendency to cling or adhere to the surfaces of the rollers 38. This is important, as will be made clear subsequently, because it is necessary that the rollers 38 be capable of rotating under heavy loads.

The block used has a thickness of one inch, in its uncompressed condition. At the time of installation, it was compressed by first putting the rollers in place and then tightening the cap screws 36 to press the rollers 38 firmly against the surface of the block as the flange plates 34 were drawn against the bottom surfaces of the sides 32.

Figure 6:
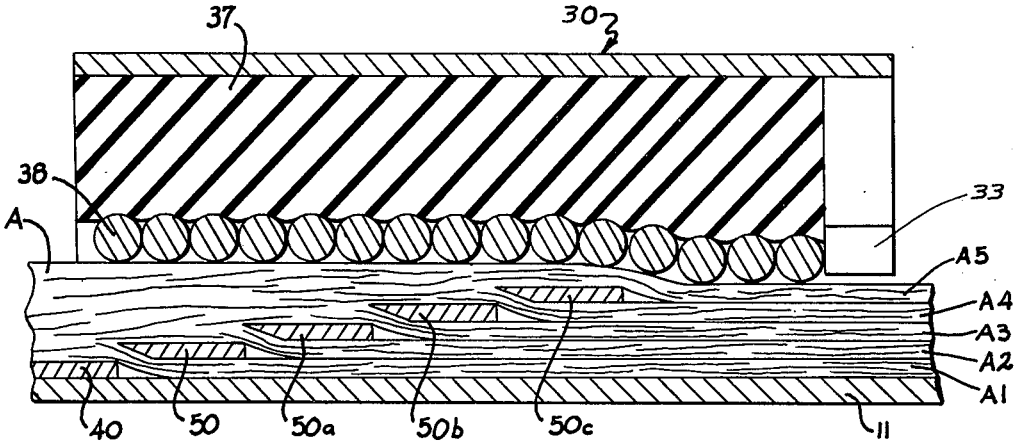
FIG. 6 is an enlarged, fragmentary, sectional view of the invention showing the machine in the process of slicing a block of wood.

The workpiece or block to be sheared is indicated in phantom in FIG. 1 by the letter A. It is also illustrated in section in FIG. 6. It is supported on the spacer plate 40. The spacer plate 40 has a thickness equal to that of one of the shearing blades 50 and it terminates approximately at the leading edge of the first of the shearing blades (FIG. 6).

The workpiece of forcibly moved against the shearing blades by the hydraulic ram 41 equipped with an extendable piston rod and head 42.

Beneath the pressure head 30 are the shearing blades 50. The number of blades used will depend upon the machine's design, the force available to move the workpiece, the type of wood and the holding capacity of the pressure head 30. In the particular embodiment illustrated, four shearing blades, 50, 50*a*, 50*b* and 50*c* are employed.

Figure 5:
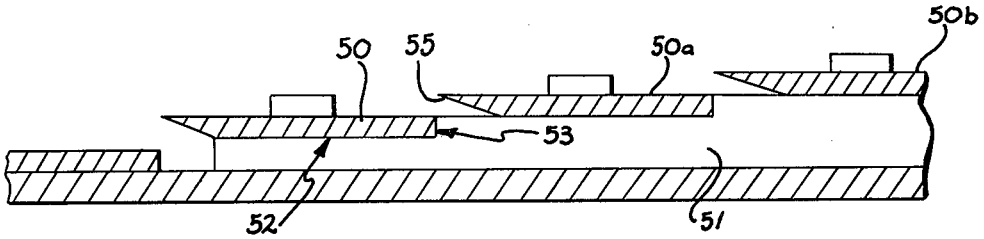
FIG. 5 is an enlarged, fragmentary, partially sectional view of the shearing blades and their mounting structure.

The blades are mounted at each end on a stepped blade support 51. For each blade the support 51 provides a flat supporting surface 32 and a positive back stop 53 (FIG. 5). The height of each step is dependent upon the thickness of the slice to be sheared from the block. This can be varied by the use of shims between the supporting surface 52 and the blade. The blades are removably but rigidly secured to the support blocks by suitable means such as the cap screws 54. The support blocks 51 are firmly attached to the base plate 11 by suitable means such as bolts, screws or welding to positively eliminate any possibility of movement under the operating forces imposed on them. The leading edge of the blades must be at or almost at the trailing edge of the preceding blade. If the spacing, in the direction of workpiece movement exceeds the normal depth of the blade, a filler piece of the same thickness as the blade must be provided so its trailing edge is at or almost at the leading edge of the next following blade.

The blade supports are spaced apart laterally of the machine a distance sufficient to permit the workpiece or block A to pass between them. The blades 50 are preferably fabricated of high speed steel of 3/32 to ⅝ inches thick. The cutting edge is at the top of blade and is formed by a single, downwardly facing bevel 55 at an acute angle of 18° to 28°. It has been determined by tests that a bevel angle significantly exceeding 28° tends to split the wood rather than shear it and this tendency increases as the angle increases. Bevel angles below 18° create cutting edges which are generally too weak and at 15° the cutting edge has a decided tendency to degrade, i.e., chip.

It has been determined that the harder woods such, for example, as sugar maple and white ash are better sheared at the higher bevel angle. Softer woods shear better at a smaller bevel angle. It has been found that 22° provides a blade having satisfactory operating characteristics over a wide range of operating conditions.

It is important that the cutting edge of the blades be arranged normal or perpendicular to the direction of movement of the workpiece A. It has been determined that blades arranged with their cutting edges other than normal have a tendency to split and crack the wood rather than shear it. The greater the angle, the greater the tendency to crack.

OPERATION

Figure 7:
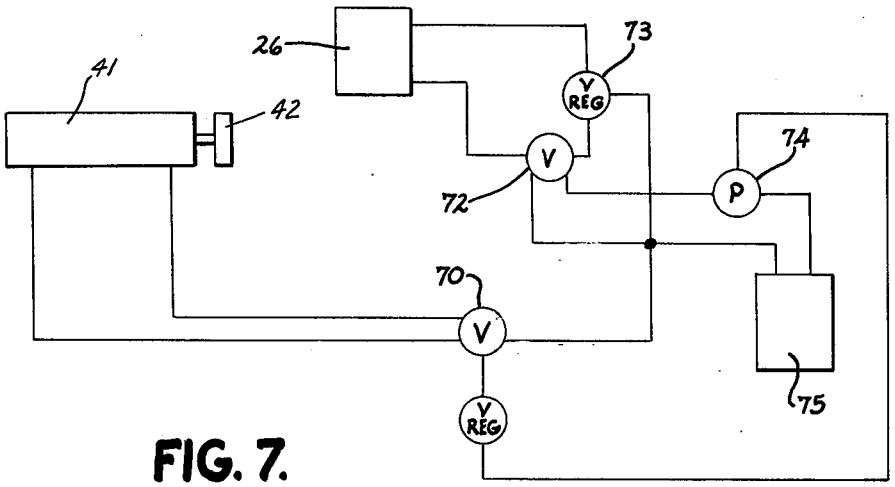
FIG. 7 is a diagrammatic presentation of the basic controls for the machine.

To operate the equipment, a block of wood A, for example, a block of four inches in width and two inches in height and of a length which can be inserted between the piston head 42 and the leading edge of the pressure or hold down head 30 is placed on the machine and by opening the valve 70 to activate the ram 41 (FIGS. 1 and 7), it is forced forwardly. As it moves ahead it first is pushed under the pressure head 30 and then contacts the first of the blades 50 (FIG. 6). At this point, it does or has moved beyond the trailing or discharge edge 71 of the spacer 40. It is important that the workpiece be firmly engaged by the pressure head 30 before the first of the knives 50 is engaged. In some cases, it may be desirable to steam the wood before slicing it.

Sufficient hydraulic pressure is exerted by the cylinder 26 to enable the pressure head to hold the top surface of the block in the same horizontal plane as it occupied when it first passed beneath the pressure head. Continued actuation of the ram 41 pushes the block A past the first blade 50 and progressively past each of the other blades 50*a*, 50*b* and 50*c*. As it does so, the block A is sequentially sheared into five strips or planks or panels $A_1$, $A_2$, $A_3$, $A_4$ and $A_5$ normally each of the same thicknesses. However, strips of different thicknesses may be sheared simultaneously.

It will be observed from FIG. 6 that the blades are offset in the diection of movement of the wood block or workpiece, a distance at least that of the fore and aft width of the blade. Thus, as the first slice is sheared by blade 50, it is forced downwardly under the blade the thickness of the blade. The space necessary for this is created by the termination of the spacer plate 40. Thus, the total thickness of the block A is not increased. The second blade 50*a* enters the block and shears the second slice as the block passes downstream of and beyond the first blade 50. Again, the thickness of the second blade 50*a* is compensated for by the downward shifting of the second slice immediately downstream or behind the second blade.

The same occurs behind the third blade 50*b*. Following the fourth or last blade 50*c*, the top slice is pressed downwardly by the rollers 38. This is important to control warpage of the slices. This is where the use of the pressure block 37 is important because it is capable of applying the necessary pressure while automatically adjusting for the reduction in effective thickness behind the last of the blades. The pressure block 37 in similar manner provides adequate and effective pressure while compensating for variations in the vertical height of the workpiece. The particular material used for the pressure block 37 exerts pressure both vertically and horizontally, thus providing a degree of pressure equalization.

Preferably, the amount of unit pressure exerted on the wood block is no more than that necessary to prevent the wood curling upwardly away from the blades. This is desirable to keep the force required to slide the block over the surface of the plate 11 at a minimum. It is important to avoid use of excess pressure which can result in pressure degradation of the wood. Actuation of the pressure head is controlled by the valve 72 and the unit pressure is controlled by the adjustable pressure regulator 73. The fluid is pressurized by the pump 74 from the reservoir 75. It is necessary to use a flat bottom plate to provide a positive back stop and height guide for the workpiece while it is under the pressure head. Rollers or similar supports while reducing friction will provide non-uniform support.

By positively controlling the height of the workpiece, that is, preventing either the workpiece or any of the slices from curving away from the cutting edges of the blades, accurate control of slice thickness is maintained. This arrangement forces the blades to cut or shear the wood rather than to follow grain patterns and thus split the wood. This assures both uniformity of thickness and a smoothly cut surface suitable for many applications without additional finishing such as sanding. Even where additional finishing is necessary, it is of the minimal type such as sanding or polishing which wastes only a minor amount or none of the wood. As is clearly illustrated in FIG. 6, all loss of wood due to creation of saw dust or the like is eliminated.

It has been determined that this invention will successfully cut slices from 1/16 to ¾ inch in thickness. The thicker the slice the less slices that are cut simultaneously. As the slice thickness increases, the trailing edge of the spacer plate 40 is moved upstream or rearwardly. For example, when the slices are ⅝ to ¾ inch in thickness, it is rearwardly offset approximately ⅛ inch from the leading edge of the blade 50, depending upon wood species.

The pressure head provides a means of applying substantially uniform unit pressure to the workpiece throughout the slicing operation. The use of numerous relatively small diameter rods provides closely spaced areas of contact between the rods 38 and the workpiece. The use of the rods provides a rolling contact with theworkpiece, thus reducing frictional resistance to movement. Even under circumstances in which the rods do not rotate, their small diameter and curved surfaces contribute to reduction in the force necessary to operate the equipment. The particular material used for the pressure block 37 is preferably characterized by a surface having a low coefficient of friction and, thus, reduced resistance to rotation of the rods.

The use of the numerous, small diameter rods permits the machine to accommodate workpieces having a nonuniform thickness such as a hump created by a knot or having a small taper in height from one end to the other or even a limited degree of lateral taper. This is so since each rod is independently, vertically adjustable. This independence of the rods is coupled with a resilient support, the pressure block 37, which redistributes and equalizes forces resulting from rod movement to maintain substantially uniform unit pressure. All of this contributes to an effective hold down for the workpiece and, thus, uniformity of the end product.

Figure 8:
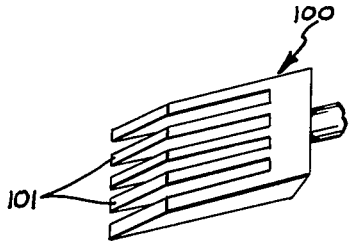
FIG. 8 is a fragmentary, oblique view of a modified head for the workpiece ram.

Normally, the workpieces are fed through the machine in tandem with the next following block pushing the remainder of the preceding block through the machine. Because the blades 50 are offset lengthwise of the machine, it may be necessary to provide means to force the last of the workpieces A past the last of the blades. This can be done by providing a short block between the workpiece and head 42 just long enough to push the workpiece past the last blade before the head 42 contacts the first blade. An alternative, when the thicker slices are being cut, is the use of a head 100 having spaced segments 101 of the thickness and spacing to pass between the blades (FIG. 8).

It will be recognized that while the invention is particularly useful when plural sheets are sheared simultaneously by the use of multiple blades, the invention is also useful for the shearing of single sheets at each pass using a single knife. The controlled vertical pressure applied to the workpiece as it passes through the knife is also effective to control curling, splitting and twisting when a single sheet is sheared as when plural sheets are involved.

It will be understood that a preferred embodiment of the invention has been illustrated and described. Modifications of this embodiment can be made without departing from the principles thereof and such modifications are to be considered as included in the hereinafter appended claims, unless the language of the claims expressly states otherwise.

The embodiments of the invention in which an exclusive property or privilege is claimed are defined as follows:

1. A device for separating a wood block by shearing it into a plurality of sheet-like strips, said device including a plurality of rigidly supported, vertically spaced shearing knives, said knives arranged one behind the other to form a shearing zone, a wood block supporting base and means for forcing a wood block along said base and past said knives, the improvement in said device comprising: a pressure applicator having a surface for engaging the face of a wood block opposite from said base; said surface being formed of a plurality of separate elements extending the full width of the wood block and resilient means for separately urging each of said elements against the wood block, said applicator extending the entire length of said shearing zone and downstream of the last of said knives.

2. A device as described in claim 1 wherein each of said elements is a rod-like roller.

3. A device as described in claim 2 wherein the end of said applicator remote from said forcing means has a stop for engaging the adjacent one of said elements; said elements being arranged in side-by-side contact with each other and each being independently rotatable with respect to each adjacent element.

4. A device as described in claim 2 wherein said applicator has a pair of sides; each of said sides having an inwardly directed, generally horizontal flange; the ends of said elements extending over said flanges and resting thereon.

5. A device as described in claim 1 wherein said resilient means is a block of resilient, compressible material.

6. A device as described in claim 5 wherein said resilient means is comprised of a plurality of layers of polyurethane elastomer having a durometer of about 85 Shore A.

7. A device as described in claim 6 wherein said layers of polyurethane have a combined thickness of approximately one inch.

8. A device as described in claim 4 wherein an applicator supporting frame is provided; said applicator having a header joining said sides and said resilient means being compressed between said header and said elements for pressing said roller firmly against said flanges; adjustable means secured to said supporting frame adjustably supporting said applicator above said base.

9. A device for separating a wood block by shearing it into a plurality of sheet-like strips, said device including a plurality of rigidly supported, vertically spaced shearing knives, said knives arranged one behind the other and forming a shearing zone, a wood block supporting base and means for forcing a wood block along said base and past said knives, the improvement in said device comprising: a pressure applicator having a friction reducing face for contacting the face of a wood block opposite from said base said face being formed of a plurality of rollers arranged side by side; resilient means common to all said rollers urging them against the wood block; each of said blades having a cutting edge formed by the intersection of the top face of the blade and a surface inclined upwardly in an upstream direction with respect to the movement of the wood block; the cutting edges of each of the blades behind the first blade being disposed in substantially the same vertical plane as the back edge of the blade ahead whereby the vertical space available to be occupied by the wood remains substantially uniform throughout the entire length of the shearing zone.

10. A device as described in claim 9 wherein the angle included between said top face of said blade and said inclined face is between 18° and 28°.

11. A device as described in claim 9 wherein the angle included between said top face and said inclined face of said blade is approximately 22°.

12. A device as described in claim 9 wherein the top faces of all of said shearing blades are parallel to said base surface and the cutting edges are all normal to the direction of movement of the wood block.

13. A device as described in claim 1 wherein said base has a step therein forming a vertical wall facing downstream with respect to the direction of movement of the wood block; said step being of a height equal to the thickness of the first of said shearing blades and aligned in the same vertical plane as the cutting edge of said first vertical blade.

14. A device as described in claim 1 wherein the wood block contacting surface of said base is downwardly stepped beneath the cutting edge of said first blade.

15. A device as described in claim 14 wherein said applicator surface is elongated normal to the axes of said elements, said surface extending with respect to the direction of movement of the wood block both upstream of the cutting edge of said first shearing blade and downstream of the back edge of the last of said shearing blades.

16. A head for applying substantially uniform pressure to an object of non-uniform thickness and/or non-uniform resistance to compressive forces being moved beneath while supported on a stationary surface, said head having a top plate and comprising: a pair of sides depending from said top plate and each having an inwardly directed flange and defining a workpiece path therebetween; a stop wall at one end of said plate, the bottom edge of said stop wall being above the top surface of said flanges; a plurality of rodlike small diameter rollers seated on said flanges in side-by-side relationship, each of said rollers being independently rotatable with respect to each adjacent roller; a pad of a resiliently compressible elastomeric material compressed between said rollers and said top plate for separately and individually resisting the lifting of said rollers off said flanges, each of said rollers being free to lift a different amount from said flanges in response to differences in thicknesses and compressibility of a workpiece.

17. A head as described in claim 16 wherein said pad is a sheet of polyurethane having a low coefficient of surface friction and a durometer of approximately 85 Shore A.

18. A device for shearing a sheet-like strip from a wood block, said device including a rigidly supported shearing knife, a wood block supporting base and means for forcing a wood block along said base and past said knife, the improvement in said device comprising: a pressure applicator having a surface for engaging the face of a wood block opposite from said base; said surface being formed of a plurality of individual, roller-like elements extending the full width of the wood block and arranged in side-by-side contact and resilient means for separately urging each of said elements against the wood block.

19. A device as described in claim 18 wherein said resilient means is a block of resilient, compressible polyurethane elastomer material.

* * * * *

UNITED STATES PATENT AND TRADEMARK OFFICE

CERTIFICATE OF CORRECTION

PATENT NO. : 4,019,548

DATED : April 26, 1977

INVENTOR(S) : Thomas A. Lenderink and Roger P. Hordyk

It is certified that error appears in the above-identified patent and that said Letters Patent are hereby corrected as shown below:

Column 1, line 68:

"automtically" should be --automatically--

Column 3, line 35:

"of" should be --is--

Column 3, line 68:

after "top of" insert --the--

Column 4, line 50:

"diection" should be --direction--

Column 5, line 53:

"theworkpiece" should be --the workpiece--

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*